US007314094B2

(12) United States Patent
Gow et al.

(10) Patent No.: US 7,314,094 B2
(45) Date of Patent: Jan. 1, 2008

(54) CONCEALED COVER FOR A FIRE SPRINKLER HEAD

(76) Inventors: Matthew J. Gow, 1039 109th Ave. NW., Coon Rapids, MN (US) 55448; Thomas W. Gow, 1039 109th Ave. NW., Coon Rapdis, MN (US) 55448

( * ) Notice: Subject to any disclaimer, the term of this patent is extended or adjusted under 35 U.S.C. 154(b) by 159 days.

(21) Appl. No.: 11/131,080

(22) Filed: May 17, 2005

(65) Prior Publication Data

US 2006/0260821 A1 Nov. 23, 2006

(51) Int. Cl.
*A62C 37/08* (2006.01)
*A62C 39/00* (2006.01)

(52) U.S. Cl. ..... 169/38; 169/37; 169/90; 169/40; 169/41

(58) Field of Classification Search ..... 169/37–42, 169/DIG. 3; 239/498
See application file for complete search history.

(56) References Cited

U.S. PATENT DOCUMENTS 2,389,331 A * 11/1945 Tyden ..... 169/37
3,459,266 A 8/1969 Ault
4,014,388 A 3/1977 Anderson
4,015,665 A * 4/1977 Simons et al. ..... 169/40
4,066,129 A * 1/1978 Anderson ..... 169/37
4,105,076 A 8/1978 Simons et al.
4,880,063 A * 11/1989 Leininger et al. ..... 169/37
4,926,946 A * 5/1990 Polan ..... 169/37
4,977,963 A * 12/1990 Simons ..... 169/37
5,020,601 A 6/1991 Retzloff et al.
5,094,298 A * 3/1992 Polan ..... 169/41
5,097,906 A * 3/1992 Polan ..... 169/37
5,372,203 A * 12/1994 Galaszewski ..... 169/37
6,152,236 A 11/2000 Retzloff et al.
6,805,203 B2 10/2004 Retzloff et al.
6,840,329 B2 1/2005 Kikuchi et al.
2002/0129946 A1 9/2002 Retzloff et al.

FOREIGN PATENT DOCUMENTS

JP 52011700 A * 1/1997
JP 2003265642 A 9/2003

* cited by examiner

*Primary Examiner*—Kevin Shaver
*Assistant Examiner*—James S. Hogan
(74) *Attorney, Agent, or Firm*—Nawrocki, Rooney & Sivertson, P.A.

(57) ABSTRACT

A spring-loaded device conceals a recessed sprinkler head. Heat releases the spring and exposes the sprinkler head.

11 Claims, 4 Drawing Sheets

CONCEALED COVER FOR A FIRE SPRINKLER HEAD

BACKGROUND OF THE INVENTION

Sprinkler systems are installed in many commercial and residential buildings. They prove to be highly effective in extinguishing fires before the fire injures occupants or spreads.

A typical sprinkler system has a water reservoir, a number of sprinkler heads installed in or close to the ceilings at various locations in the protected spaces, and a dedicated rigid piping system that supports the sprinkler heads and delivers the water from the reservoir to the sprinkler heads. Each sprinkler head has a valve controlled by a temperature sensitive element such as a fusible link or liquid-filled vial. Heat from a fire activates the element for example by melting the link to release the water through the valve to extinguish the fire.

A certain sprinkler head design is normally held in a retracted state by the fusible link. Such a sprinkler head can be installed in a recessed position above the lower surface of the ceiling. The ceiling has a hole below such a sprinkler head. If the fusible link melts, the sprinkler head extends downward under pressure of the water in the piping to below the ceiling surface so as to direct the water spray over a wide area of the protected space.

Sprinkler heads often project from the ceiling surfaces, although newer designs have heads recessed in a hole in the ceiling with a cover over the hole. Projecting sprinkler heads particularly are vulnerable to vandalism.

One problem with such recessed sprinkler heads is that they are exposed to view through the ceiling hole. If a cover plate is installed to conceal the sprinkler head, the cover plate must fall away when the sprinkler head is deployed during a fire. The cover plate may also insulate the sprinkler head from the heat of a fire, perhaps delaying deployment of the sprinkler head. Whether recessed or not, sprinkler heads and the covers for recesses containing them are not esthetically pleasing. The industry may well welcome an opportunity to conceal sprinkler heads without the disadvantages of current designs.

BRIEF DESCRIPTION OF THE INVENTION

A means for providing these functions comprises a device for revealing, responsive to heat, a component recessed in the surface of a room. In one version the device includes a barrel comprising a cylindrical wall defining a bore therein for encircling the component. The cylindrical wall has a first end having a flange projecting radially outward therefrom, and a second end opposite the first end.

A helical compression spring surrounds the cylindrical wall. The spring has a first end that presses against the flange, and opposite thereto, a second end.

A spring retainer is attached to the second end of the wall and engages the second end of the spring to hold the spring in compression. The retainer is of the type including a release mechanism activating at a predetermined safety temperature to allow the spring to extend. The mechanism maintains compression of the spring prior to activating.

DESCRIPTION OF THE PREFFERED EMBODIMENTS

Figure 1:
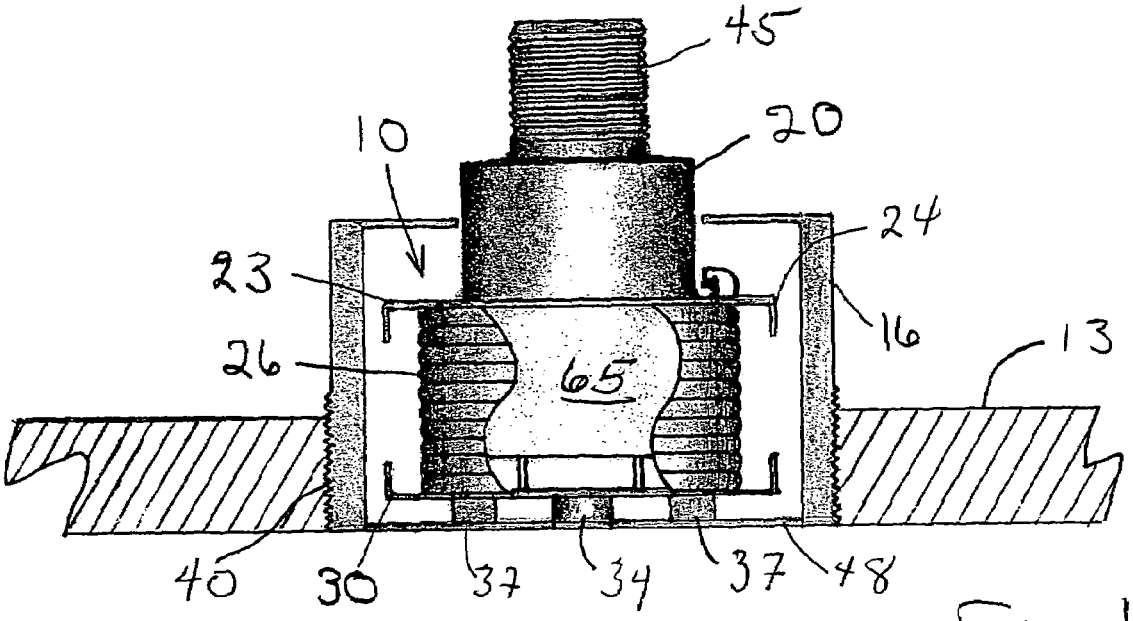
FIG. 1 is a side plan view of the invention as installed in a through-hole of a ceiling.

The device 10 shown in FIG. 1 is for use with a component such as a recessed sprinkler head 20 concealed above a ceiling 13. Device 10 will reveal sprinkler head 20 to the space below ceiling 13 in case heat such as a fire causes, impinges device 10. Device 10 is designed to form a part of an installation where the sprinkler head 20 is of the normally retracted type, and to avoid some of the disadvantages mentioned in the Background section for retracted heads.

In FIG. 1, a ceiling 13 has a sleeve 16 threaded into a hole cut to the proper size to engage threads 40. Often, ceiling 13 is a tile of the suspended type typically laid into a frame suspended from the bottom of the next story's floor.

Sprinkler head 20 has a threaded attachment 45 for threading into the sprinkler piping system. In one design, device 10 is suspended from sprinkler head 20.

Figure 3:
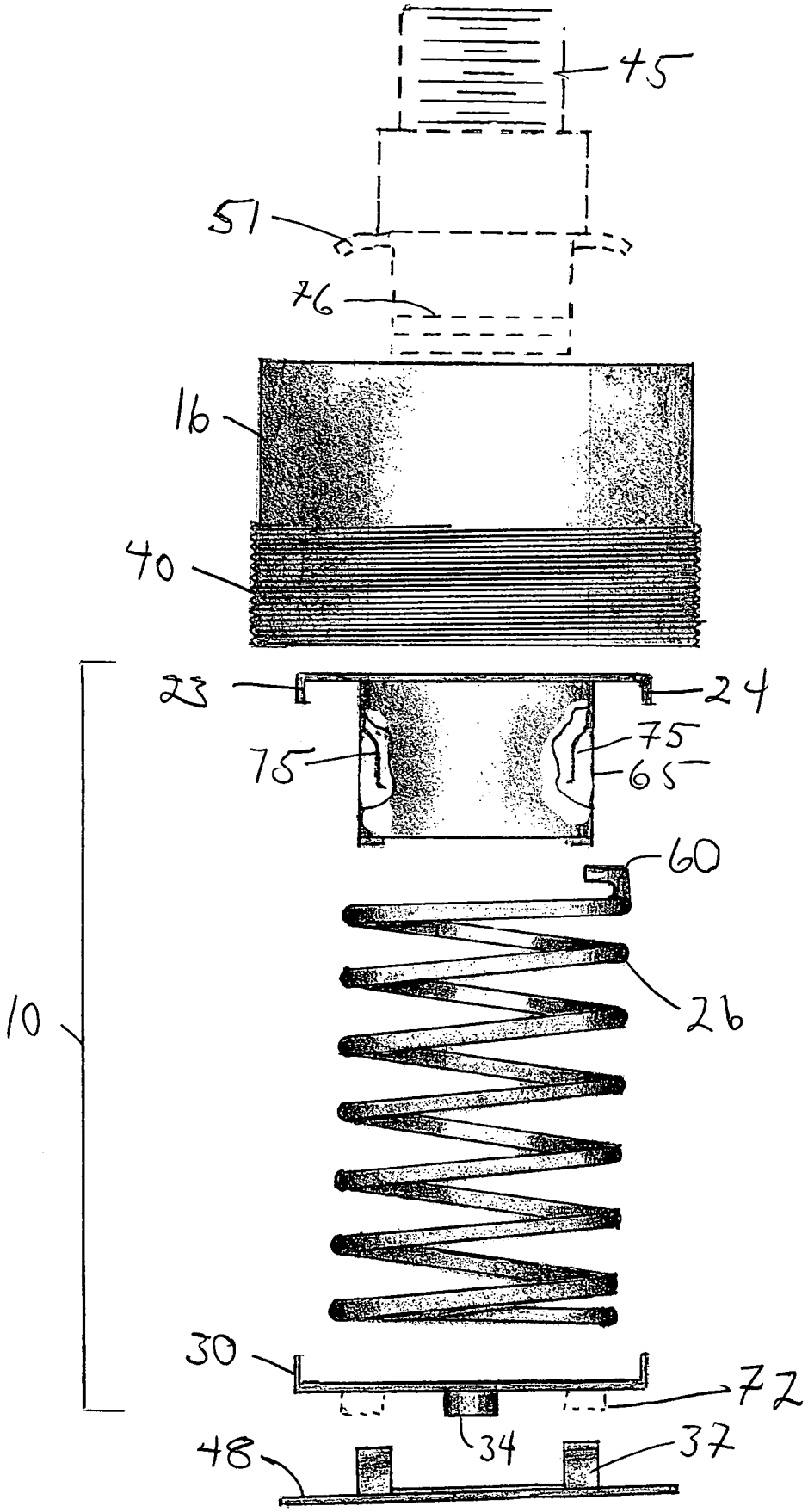
FIG. 3 is a plan, exploded view of the invention shown in FIG. 1.
Figure 4:
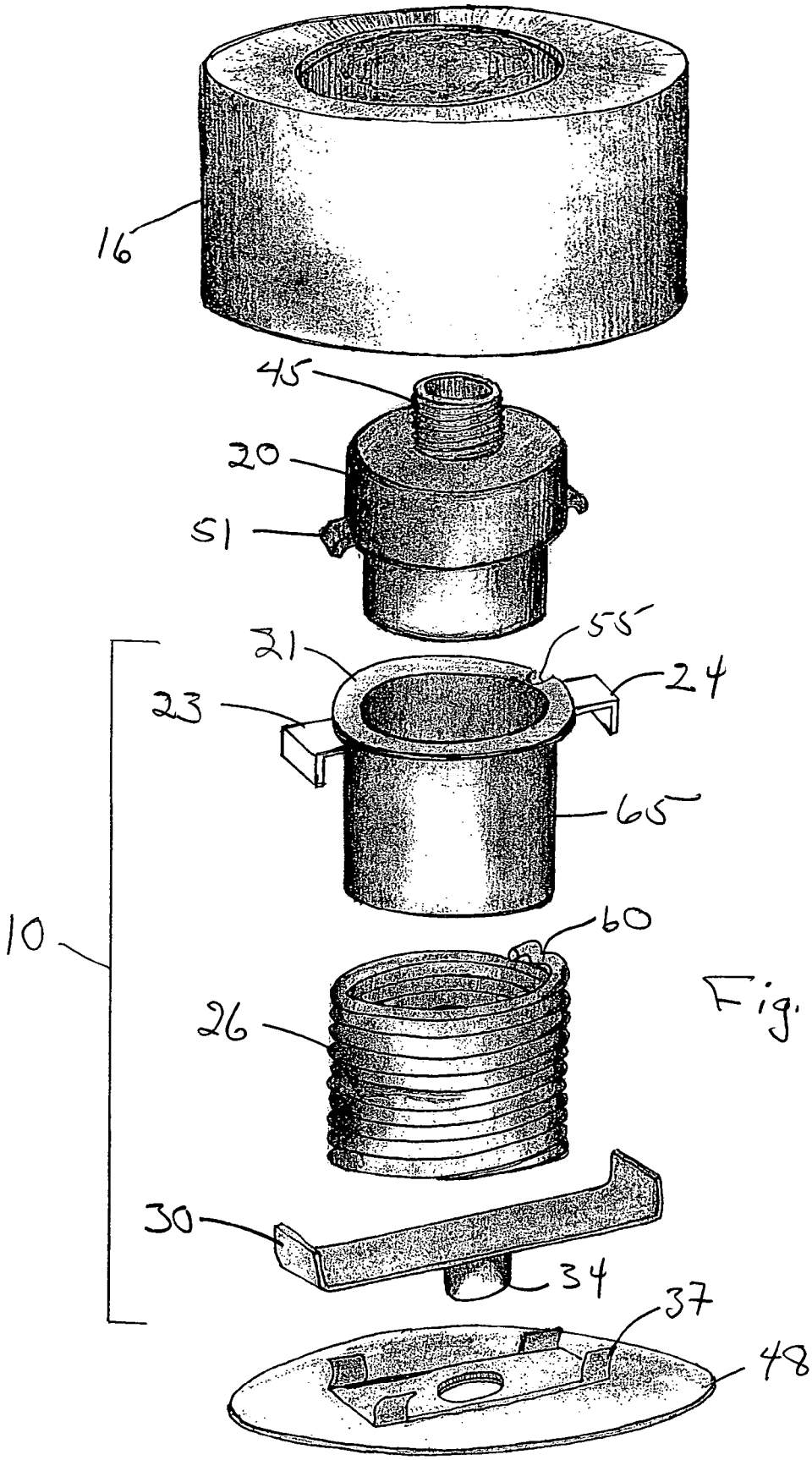
FIG. 4 is a perspective, exploded view of the invention shown in FIG. 1.

Device 10 is best understood with reference to FIGS. 3 and 4 which show device 10 in exploded view. FIG. 3 shows the parts of device 10 as staged just prior to assembly. A barrel 65 has a wall defining a bore. Barrel 65 has an upper or first end from which a flange 21 and upper brackets 23 and 24 radially project. Flange 21 adds stiffness to barrel 65. Typically, barrel 65 may be made from brass or copper.

FIG. 1 shows a helical compression spring 26 with an inside diameter larger than the outside diameter of barrel 65 compressed onto barrel 65. Spring 26 is also shown compressed in FIG. 4, but of course without axial restraint, spring 26 would have the extended length shown in FIG. 3. Spring 26 may be of a design that when compressed to the maximum generates force of 20-40 lb.

A spring retainer 30 is attached to the bottom or second end of barrel 65. Retainer 30 may comprise copper or brass, or other metal that conducts heat well. Retainer 30 comprises a bar extending diametrically across and radially outwards from the second end of barrel 65 to engage the lower end of spring 26. Retainer 30 cooperates with flange 21 and cylindrical wall 30 to hold spring 26 in compression against flange 21 and/or brackets 23 and 24.

Figure 2:
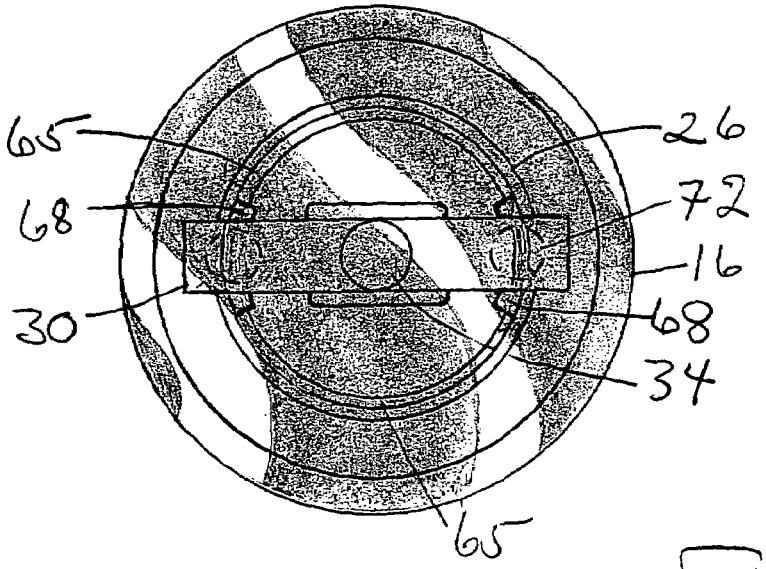
FIG. 2 is a bottom plan view of the invention with a cover removed.

Spring retainer 30 includes a release mechanism that when heated changes state in some way to release spring 26. In the preferred design, the release mechanism comprises solder pads 68 shown in FIG. 2 that form a part of retainer 30. Solder pads 68 are formed of solder material that disintegrates by melting at a predetermined safety temperature. A liquid-filled vial that breaks when exposed to heat may also serve as the release mechanism.

In the preferred design shown, solder 68 pads comprise low-temperature solder that fastens retainer 30 to the bottom end of barrel 65 to maintain compression of spring 26 so long as a predetermined temperature is not exceeded. In one design, solder 68 pads meld at 165° F.

A wide variety of heat-sensitive release mechanisms and retainer 30 designs are possible. The important factor is for retainer 30 to release spring 26 when the release material exceeds a predetermined temperature.

Retainer 30 may include at least one heat-conducting boss 34 for efficiently conducting heat to solder pads 68, or to whatever serves as the heat-sensitive mechanism. FIG. 3 shows two bosses 72 in phantom located to conduct heat through a shorter thermal path to solder pads 68.

A cover plate 48 provides mechanical protection and esthetic appearance for sprinkler head 20. A spring cover clip 37 is attached to cover 48 and allows cover 48 to be attached to retainer 30. A hole in cover 48 allows boss 34 to project through cover 48 in flush alignment with the cover 48 bottom.

Spring 26 will release more reliably if device 10 is mounted in a smooth-walled housing such as sleeve 16. In one preferred version, sleeve 16 has an external thread 40 An installer installs sleeve 17 by turning same into a properly sized hole in ceiling 13.

Heat from a fire heats boss 34. Boss 34 conducts heat to retainer 30 along which the heat flows to solder pads 68. The heat disintegrates solder pads 68 releasing spring 26 and detaching cover plate 48. Heat from the fire has now direct access to sprinkler head 20, which will almost immediately operate to release water. Two bosses 72 as shown in FIG. 3 may conduct heat even more efficiently to solder pads 68.

The expansion force generated by spring 26 must be adequate to break any paint that may be present that bonds cover plate 48 to sleeve 16. Experience shows that 20-40 lb. is adequate.

Further, the extended spring 26 should not interfere with the distribution of water from the extended sprinkler head 20. To assure this, the extension of spring 26 should be limited to keep the lowest turn above the trajectory of the water from sprinkler head 20. A number of simple solutions exist, such as designing the spring 26 with a limited maximum extension.

Barrel 65 may include mounting clips 75 designed to engage sprinkler head 20. In one design, mounting clips 75 are internal as shown with tips that engage external circumferential grooves 76 such as threads in sprinkler head 20. Clips 75 prevent device 10 from falling when solder pads 68 melt.

In order to keep spring 26 from falling away from barrel 65 when solder pads 68 melt, FIG. 4 shows flange 21 with a notch 55. Spring 26 has a hook 60 designed to engage notch 55 to retain spring 26 on barrel 65 after release of spring 26.

Figure 5:
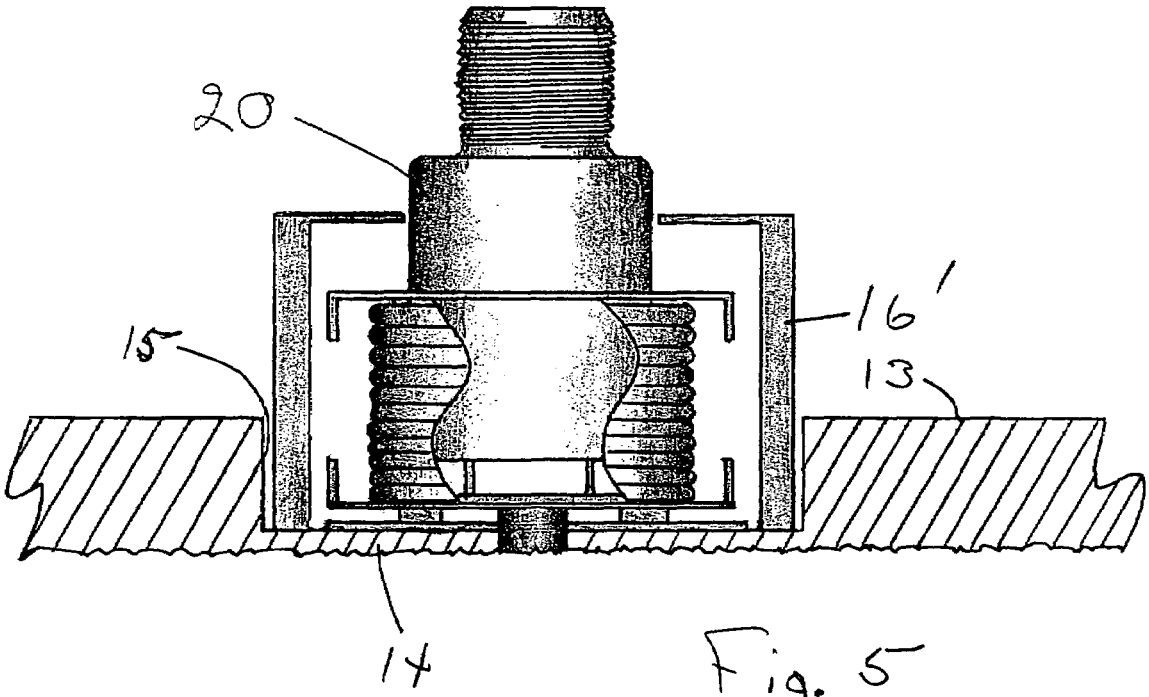
FIG. 5 is a side plan view of the invention as installed in an upwardly facing recess in a ceiling.

FIG. 5 shows design for a housing comprising sleeve 16 that completely conceals sprinkler head 20. A recess or depression 15 is cut in the upper surface of ceiling 13 leaving a thin layer 14 of ceiling material. For this embodiment, ceiling 13 should comprise a relatively low strength material such as that from which ceiling tiles are made.

When the release material releases spring 26, the force of spring 26 when released will break through layer 14 to expose sprinkler head 20. In this design, the installer must take care to assure that the strength and toughness of ceiling 13 material and the thickness of layer 14 are all small enough to allow the force of spring 26 to break through layer 14. On the other hand, the strength of layer must be fully adequate to prevent sleeve 16' and device 10 from falling through. The manufacturer may need to provide an adequate installation specification and perhaps a specialized tool for creating a suitable recess for sleeve 16' and device 10 with a layer 14 that is neither too strong nor too weak.

The invention claimed is:

1. A device for revealing, responsive to heat, a component recessed in the surface of a room, said device including:

a) a barrel comprising a cylindrical wall defining a bore therein for encircling the component, said cylindrical wall having a first end having a flange projecting radially outward therefrom, and a second end opposite the first end;

b) a helical compression spring surrounding the cylindrical wall, said spring having a first end pressing against the flange, and having a second end;

c) a spring retainer attached to the second end of the cylindrical wall and engaging the second end of the spring to hold the spring in compression, said retainer including a release mechanism activating at a predetermined safety temperature, said mechanism maintaining compression of the spring prior to activating, d) wherein the retainer comprises a bar extending radially outward from the cylindrical wall and at least part way across the bore at the second end of the sleeve, and wherein the release material comprises low temperature solder attaching the bar to the second end of the cylindrical wall.

2. The device of claim 1, wherein the bar extends diametrically across the second end of and radially outwards from, the cylindrical wall.

3. The device of claim 1, including a heat-conducting boss in thermal contact with the bar and projecting away from the first end of the cylindrical wall.

4. The device of claim 3, including a pair of heat-conducting bosses carried on the bar, each attached adjacent to a point where low temperature solder contacts the bar.

5. The device of claim 1, including a cover disc and an attachment feature for attaching the cover disc to the bar.

6. The device of claim 5, wherein the attachment feature comprises a spring cover clip mounted to a side of the cover for detachably clipping the cover disc to the bar.

7. A device for revealing, responsive to heat, a component recessed in the surface of a room, said device including:

a) a barrel comprising a cylindrical wall defining a bore therein for encircling the component, said cylindrical wall having a first end having a flange projecting radially outward therefrom, and a second end opposite the first end;

b) a helical compression spring surrounding the cylindrical wall, said spring having a first end pressing against the flange, and having a second end;

c) a spring retainer attached to the second end of the cylindrical wall and engaging the second end of the spring to hold the spring in compression, said retainer including a release mechanism activating at a predetermined safety temperature, said mechanism maintaining compression of the spring prior to activating;

d) wherein the flange on the barrel has a feature for retaining the spring, and wherein the spring has a feature for connecting to the spring-retaining feature of the barrel's flange; and e) wherein the spring-retaining feature of the barrel's flange comprises a notch in the flange, and wherein the spring's connecting feature comprises a hook forming a part of the spring.

8. A device for revealing, responsive to heat, a component recessed in the surface of a room, said device including:

a) a barrel comprising a cylindrical wall defining a bore therein for encircling the component, said cylindrical wall having a first end having a flange projecting radially outward therefrom, and a second end opposite the first end;

b) a helical compression spring surrounding the cylindrical wall, said spring having a first end pressing against the flange, and having a second end;

c) a spring retainer attached to the second end of the cylindrical wall and engaging the second end of the spring to hold the spring in compression, said retainer including a release mechanism activating at a predetermined safety temperature, said mechanism maintaining compression of the spring prior to activating including a feature within the barrel for cooperating with the component for supporting the device in surrounding relation to the component; and d) wherein the component comprises a cylinder having a predetermined shape to fit within the barrel's bore, and wherein the barrel includes a spring clip within the bore, and resiliently engaging the component.

9. The device of claim 8, wherein the component cylinder has a peripheral groove, and wherein the spring clip includes a projection engaging the peripheral groove.

10. A device for revealing, responsive to heat, a component recessed in the surface of a room, said device including:

a) a barrel comprising a cylindrical wall defining a bore therein for encircling the component, said cylindrical wall having a first end having a flange projecting radially outward therefrom, and a second end opposite the first end;

b) a helical compression spring surrounding the cylindrical wall, said spring having a first end pressing against the flange, and having a second end;

c) a spring retainer attached to the second end of the cylindrical wall and engaging the second end of the spring to hold the spring in compression, said retainer including a release mechanism activating at a predetermined safety temperature, said mechanism maintaining compression of the spring prior to activating; d) wherein a ceiling includes an area having a hole whose center is in approximate alignment with the component, and including a sleeve for encircling the device of claim 9 and mounting within the hole in the ceiling.

11. The device of claim 10, wherein the sleeve has an end for retaining within the hole in the ceiling, wherein said sleeve end includes an external thread for engaging the hole in the ceiling.

* * * * *